US010478711B2

(12) United States Patent
Stoll

(10) Patent No.: US 10,478,711 B2
(45) Date of Patent: Nov. 19, 2019

(54) POINTS AND BID CARD GAME

(71) Applicant: Peter Stoll, Salt Lake City, UT (US)

(72) Inventor: Peter Stoll, Salt Lake City, UT (US)

( * ) Notice: Subject to any disclaimer, the term of this patent is extended or adjusted under 35 U.S.C. 154(b) by 0 days.

(21) Appl. No.: 15/923,265

(22) Filed: Mar. 16, 2018

(65) Prior Publication Data

US 2018/0264351 A1 Sep. 20, 2018

Related U.S. Application Data

(60) Provisional application No. 62/472,198, filed on Mar. 16, 2017.

(51) Int. Cl.

| | |
|---|---|
| ***A63F 1/00*** | (2006.01) |
| ***A63F 1/18*** | (2006.01) |
| ***A63F 1/04*** | (2006.01) |
| ***A63F 3/00*** | (2006.01) |
| *A63F 1/10* | (2006.01) |
| *A63F 11/00* | (2006.01) |

(52) U.S. Cl.

CPC ..... *A63F 1/18* (2013.01); *A63F 1/00* (2013.01); *A63F 1/04* (2013.01); *A63F 3/00* (2013.01); *A63F 1/10* (2013.01); *A63F 3/0052* (2013.01); *A63F 3/00261* (2013.01); *A63F 3/00895* (2013.01); *A63F 2001/0408* (2013.01); *A63F 2001/0416* (2013.01); *A63F 2001/0458* (2013.01); *A63F 2001/0475* (2013.01); *A63F 2001/0491* (2013.01); *A63F 2003/00268* (2013.01); *A63F 2003/00523* (2013.01); *A63F 2011/0067* (2013.01)

(58) Field of Classification Search

CPC ..... A63F 1/00; A63F 1/10; A63F 2001/001; A63F 2001/0408; A63F 2001/0416; A63F 2001/0458; A63F 2001/0475; A63F 2001/0491; A63F 3/00261; A63F 3/0052; A63F 3/00895; A63F 2003/00268; A63F 2003/00523

USPC .... 273/292, 296, 303–306, 308, 280, 148 A, 273/148 R

See application file for complete search history.

(56) References Cited

U.S. PATENT DOCUMENTS 1,060,900 A * 5/1913 Hobbs ..... A63F 1/02 273/304
1,243,263 A * 10/1917 Cohen ..... A63F 1/02 273/306
1,583,223 A * 5/1926 Cooke ..... A63F 1/02 273/308

(Continued)

*Primary Examiner* — Benjamin Layno
(74) *Attorney, Agent, or Firm* — Brooks, Cameron & Huebsch, PLLC

(57) ABSTRACT

A game that includes a game hub having a draw tray and a discard tray for point cards; four game boards, four sets of score markers; sixteen indicator cards; and fifty-one point cards divided into eight classification sets and a wild card set. Each set of the eight classification sets of point cards includes six point cards, where each of the point cards has a combination of: a classification set name; a point value indicator; a symbol associated with the classification set; an image associated with the classification set name; and a common name for the image; where the combination is different for each of the point cards in the eight classification sets. The wild card set includes three point cards each having a number zero on the first major surface.

11 Claims, 7 Drawing Sheets

(56) References Cited

U.S. PATENT DOCUMENTS

| | | | | | |
|---|---|---|---|---|---|
| 1,749,653 | A * | 3/1930 | Winter | A63F 1/06 | 273/148 A |
| 1,961,014 | A * | 5/1934 | Skolnik | A63F 1/06 | 273/151 |
| 2,072,799 | A * | 3/1937 | Creswell | A63F 1/02 | 273/308 |
| 2,214,952 | A * | 9/1940 | Carothers | A63F 1/02 | 273/308 |
| 4,014,547 | A * | 3/1977 | Gomez | A63F 3/0415 | 273/243 |
| 4,682,777 | A * | 7/1987 | Wood | A63F 3/00006 | 273/243 |
| 5,112,059 | A * | 5/1992 | Mundle | A63F 1/02 | 273/292 |
| 5,549,301 | A * | 8/1996 | Gerrard | A63F 1/02 | 273/302 |
| 6,332,615 | B1 * | 12/2001 | Watanabe | A63F 1/00 | 273/298 |
| 2017/0236449 | A1 * | 8/2017 | Swanwick | G09B 19/22 | 434/295 |

* cited by examiner

600

FIG. 6

| Position / Game | A | B | C | D |
|---|---|---|---|---|
| 1 | 1 | 2 | 3 | 4 |
| 2 | 2 | 1 | 4 | 3 |
| 3 | 2 | 4 | 1 | 3 |
| 4 | 4 | 3 | 2 | 1 |
| 5 | 3 | 1 | 4 | 2 |
| 6 | 2 | 4 | 3 | 1 |
| 7 | 1 | 2 | 3 | 4 |
| 8 | 1 | 3 | 2 | 4 |
| 9 | 4 | 3 | 1 | 2 |

POINTS AND BID CARD GAME

TECHNICAL FIELD

The present application is a card game which utilizes a custom deck of cards, a custom Game Hub, custom Game Boards, custom Score Trackers, and a custom process for bidding, in order to determine a winner. In particular it is a card game in which points are spent and points are earned in order to determine a winner.

DETAILED DESCRIPTION

Game Overview

The present disclosure is to a game given the name "FourBid™ card game." FourBid™ card game is a game of chance and skill for four (4) players, where in various embodiments discussed herein, players spend and earn points to determine a winner.

As with other games (e.g., poker, hearts, and contract bridge), the cards a player is dealt and draws in the FourBid™ card game count a great deal toward their chance of winning, but success in the FourBid™ card game also depends on good tactics. When to bid, what to discard, and anticipating an opponent's needs can all significantly steer the course of how an individual Round of Play, or the Game as a whole turns out.

FourBid™ card game is a game in which each player tries to accumulate what are called herein "Net Points." As discussed herein, four different points are used in the FourBid™ card game. As just mentioned, there are Net Points. Next, there are "Points Spent," which are points spent during an individual Round of Play of the FourBid™ card game. "Earned Points" and "Bonus Points" are points awarded at the completion of an individual Round of Play of the FourBid™ card game. Net Points are derived by the formula Net Points=Earned Points+Bonus Points−Points Spent. A player's Net Points are added to Net Points from previous Rounds of Play of the FourBid™ card game. The Net Points are used to determine a winner of a Game of the FourBid™ card game.

Terms and Definitions

Often when speaking of card games, the term "Hand" has two meanings; 1) the set of cards players have been dealt or are physically holding or showing, and 2) a single Round of Play. So as not to confuse the two meanings in this document, the term "Hand" or "Hand of Cards" herein refers only to the first meaning, the set of cards a player is dealt, is holding, or is showing to other players at the end of a Round of Play. In the FourBid™ card game, a Hand always consists of eight (8) cards.

As used herein a "Round of Play" in the FourBid™ card game is defined as the playing of a single round of the FourBid™ card game from the time the cards are dealt to the time a player "Goes Out" (defined below).

As used herein a "Game" of the FourBid™ card game is defined as playing the FourBid™ card game (e.g., several Rounds of Play) from beginning to end until one player wins a game of the FourBid™ card game.

As used herein "Winning a Game" or a player that "Wins a Game" of the FourBid™ card game is defined as the player with the highest score, as soon as at least one player has reached 72 points or more. The FourBid™ card game is meant to be played as a Tournament, where players rotate position and play multiple Games. But the FourBid™ card game is equally playable as a single Game. For instance, players typically may agree to play just one or more Games to 100 or 200 points. For reference, a Game to 72 points typically last 20 minutes and requires approximately 3 Rounds of Play to complete.

As used herein a "Tournament" of the FourBid™ card game is defined as playing the FourBid™ card game according to the formal (Tournament) rules, where the first player to win 3 Games is the overall champion. In a Tournament, players must change positions at the Game Hub according to a Player Position Chart (as illustrated in FIG. 6).

As used herein a "Turn" in the FourBid™ card game is defined as the process of drawing a Point Card from the top position of the Draw Deck or the top position of the Discard Pile, and then either discarding a Point Card (Face Up) on to the top of the Discard Pile, or discarding an Indicator Card Face Up in the Indicator Card Tray of their Game Board.

As used herein a "Deck" in the FourBid™ card game is defined as the complete stack of fifty-one Point Cards, which can be shuffled together. The Point Cards that are left over after the Deal and are placed Face Down in the Draw Tray where they become the "Draw Deck."

As used herein a "first major surface" of a card in the FourBid™ card game is defined as the side of a card with varying images, values and other information pertaining to the play of the FourBid™ card game. "Face Up" refers to cards turned so their first major surface is visible for all players to see.

As used herein, a "second major surface" of a card in the FourBid™ card game is defined as a singularly themed design that all cards share. The second major surface of a FourBid™ card has no information that is meaningful to players. "Face Down" refers to cards where only the second major surface of the card is showing to players.

As used herein a "Deal" in the FourBid™ card game is the initial distribution of four (4) Point Cards to all players.

As used herein a "Draw" in the FourBid™ card game is defined as acquiring a Point Card to a player's Hand from either the Draw Deck located in the Draw Tray or the Discard Pile located in the Discard Tray during a FourBid™ Turn.

As used herein a "discard" in the FourBid™ card game is defined as a player removing either a Point Card or an Indicator Card from their Hand and placing it Face Up in the Discard Tray (if it's a Point Card) or Face Up in the Indicator Card Tray of their Game Board (if it's an Indicator Card).

As used herein a "Game Hub" of the FourBid™ card game can include the Draw Tray and the Discard Tray both of which can be mounted on a rotating platform. One of the trays is marked "Draw" and the other is marked "Discards." The Game Hub can be made of wood, plastic or other suitable material and sits on top of a "Lazy Susan" mechanism, typically made of a durable material (e.g., metal or polymer) and typically includes a bearing mechanism to allow for both the Draw Tray and the Discard Tray of Game Hub to turn or swivel 360 degrees in either direction.

As used herein a "Draw Tray" of the FourBid™ card game is the tray marked "Draw" where the Draw Deck of Point Cards are placed Face Down. The Draw Tray can include in some embodiments of a tray which is referred to herein as a Draw Tray (seen in FIG. 1B).

As used herein a "Discard Tray" of the FourBid™ card game is the tray marked "Discards" where Point Cards are placed Face Up to form the "Discard Pile." The Discard Tray can include in some embodiments of a tray which is referred to herein as a Discard Tray.

The FourBid™ card game includes sixteen (16) "Indicator Cards." The sixteen Indicator Cards are divided into four (4) sets of four (4) Indicator Cards. Each of the four sets of four Indicator Cards includes a first Indicator Card with an identifying value one (1) on the first major surface, a second Indicator Card with the identifying value two (2) on the first major surface, a third Indicator Card with the identifying value three (3) on the first major surface and a fourth Indicator Card with the identifying value four (4) and the term "FourBid™" on the first major surface. In addition, each of the four sets use a predefined color that is different from the other sets for the identifying value and the term "FourBid™" (when the identifying value is four (4)) seen on the first major surface of the Indicator Card. So, the first set of Indicator Cards may use yellow, the second set of Indicator Cards may use blue, the third set of Indicator Cards may use red and the fourth set of Indicator Cards may use green for the identifying values (1, 2, 3 and 4) and the term "FourBid™" on the Indicator Card having the identifying value 4.

As used herein an "Indicator Card Tray" of the FourBid™ card game is one of four (4) areas (one on each Game Board) used for players to place Indicator Cards Face Up. The Indicator Card Tray can include in some embodiments a tray which is referred to herein as an Indicator Card Tray (seen in FIG. 1B).

The FourBid™ card game includes fifty-one (51) "Point Cards." The fifty-one Point Cards are divided into eight (8) Classification Sets and a Wild Card Set. Each set of the eight Classification Sets of Point Cards includes six (6) Point Cards, and the Wild Card Set includes three (3) Point Cards, which by definition can belong to any of the eight Classification Sets. The first major surface of each Point Card is marked with a combination of: a Classification Set Name, a Point Value Indicator, an Image associated with the Classification Set Name and a Common Name for the Image. The combination on the first major surface is different for each of the Point Cards in the eight Classification Sets. The combination on each set of six Point Cards for the eight Classification Sets has a predetermined color, where the predetermined color is different for each Classification Set of the eight Classification Sets. So, for example, a set of six Point Cards for a first Classification Set to "Sea Birds" can use the color blue for the combination seen on each of the six Point Cards in that Classification Set, while a second set of six Point Cards for a second Classification Set to "Mammals" uses the color black for the combination seen on each of the six Point Cards in that Classification Set.

Each Point Card can also be bordered by symbols such as circles, squares or other shapes, where the number and color correspond to value indicator and/or the Classification Set. This acts as another way to quickly identify the Classification Set a Point Card belongs to. The shapes used with each Classification Set can also be unique to each set, which would allow the most relevant information to be seen by a player holding their cards in a "fan" shape or arrangement. Refer to FIG. 2 to view an example of a Point Cards used in the "Ocean Life" Themed version of the FourBid™ card game. As mentioned, the total number of Point Cards in the FourBid™ card game (including the three Wild Cards) is fifty-one (51).

As mentioned herein, the "Wild Card Set" are Point Cards that can be chosen by a player to become part of any of the eight Classification Sets. The first major surface of each of the three Wild Cards includes an image, a common name for the image and a point value indicator of zero (0). Wild cards are bordered with one of each symbol (shape and color) found in each of the eight (8) Classification Sets. Refer to FIG. 4 to view the three Ocean Life Themed Wild Cards used in the FourBid™ card game.

When in physical form, the Point Card and Indicator Cards can be formed using flat, rectangular pieces of layered pasteboard where the information on each of the cards discussed herein can be printed on the cards using a lithography, a photolithography, or a gravure process. Other process and materials are possible. The Point Card and Indicator Cards can also be represented in electronic form when the FourBid™ card game is implemented and played in a computer format (e.g., using computer readable instructions held in memory and executed in a processor to produce an output (e.g., images) and respond to input from the players) that allow the game of the FourBid™ card game to be played on a personal computer, on a website over the world wide web or as an "app" on a smartphone or tablet.

As used herein, a "Game Board" of the FourBid™ card game is defined as a place for each player to use for scoring and for discarding Indicator Cards. Game Boards have a predetermined color that can match the color of the Indicator Cards a player uses while playing the FourBid™ card game, as discussed herein. There are four (4) Game Boards. Each provides a place for a player to keep track of three (3) scores, and a tray for each player to discard their Indicator Cards. The score tracking areas include a Points Spent Tracker, a Tournament Win Tracker and a Net Points Tracker.

As used herein a "Net Points Tracker" of the FourBid™ card game is defined as those areas on the Game Boards that allow each player to keep track of their calculated Net Points.

As used herein a "Points Spent Tracker" of the FourBid™ card game is defined as those areas on the Game Boards that allow each player to keep track of their Points Spent during each Round of Play.

As used herein a "Tournament Win Tracker" of the FourBid™ card game is defined as those areas on the Game Boards that allow each player to keep track of the number of Games won during a FourBid™ Tournament.

The Game Hub and Game Boards may be manufactured in any number of methods, from any number of materials and/or in any number of manifestations (e.g., physical form or in an electronic form, as discussed herein and know in the art). For example, the Game Boards can be formed of cellulose based materials such as core of chipboard or pressed cardboard covered in paper having images, numbers, indicators and information discussed herein printed on the paper using lithography, photolithography, or gravure printing processes. The score tracking areas of the Game Boards can also include a layer of magnetic material (e.g., a ferromagnetic material) to be used with correspondingly magnetic Score Markers (discussed below) so that the Score Markers can be kept more securely in place during play of the FourBid™ card game.

As used herein a "Score Marker" of the FourBid™ card game is defined as an indicator used in tandem with the number sets so as to keep track of and indicate a player's score within each of the score tracking areas. The Score Markers can be made of a cellulose based materials (e.g., wood) or plastic and have a predetermined color that can match the predetermined color of the Indicator Cards and Game Boards a player uses while playing the FourBid™ card game, as discussed herein. The Score Marker can be physically placed on the Score Trackers of the Game Boards to indicate a player's score within each of the FourBid™ card game's score tracking areas. The Score Markers can also include a magnetic material (e.g., a magnet) on or in the base of the Score Marker ("magnetic Score Markers") that allows the Score Markers to be releasably secured to the FourBid™ card game score tracking areas when the layer of magnetic material is present under the score tracking areas.

Alternatively, the "Score Markers" used with the score tracking areas of the Game Boards can take the form of an electronic display (e.g., a liquid crystal display and/or light emitting diodes). The electronic display can be electrically coupled to electronic circuitry and a power source (e.g., a battery), where the player can operate a key pad and/or a switch to change the number indicated in each individual score tracking area.

While the FourBid™ card game is described herein as having physical articles (e.g., Point Cards, Indicator Cards, Score Markers, etc.) that are handled and used by the players in playing the FourBid™ card game, it is understood that the FourBid™ card game can be implemented and played in a computer format (e.g., using computer readable instructions held in memory and executed in a processor to produce an output (e.g., images) and respond to input from the players) that allow the game of the FourBid™ card game to be played on a personal computer, on a website over the world wide web or as an "app" on a smartphone or tablet. A computer can also be programmed to act as one or more players of the FourBid™ card game, allowing three or fewer human players to play the FourBid™ card game "against" the computer.

As used herein the "Game Contents" of the FourBid™ card game is defined as one (1) Official Rules Sheet, one (1) Tactics & Examples Booklet, one (1) Player Position Chart, one (1) Game Hub, four (4) Game Boards, fifty-one (51) Point Cards, sixteen (16) Indicator Cards, and sixteen (16) Score Markers. The number of each of these items in the Game Contents may vary depending on the type of score tracking area that's manufactured—for instance, in the case of the FourBid™ card game, Game Boards with an electronic score tracking area, there may be no physically separate Score Markers needed.

As used herein a "Theme" of the FourBid™ card game is defined as the content and artistic elements that make up a particular version of the Game. For instance, the embodiment of the FourBid™ card game in this detailed description represents an "Ocean Life" Theme, where Point Card Classification Sets and other design elements are consistent with ocean creatures and scenery. Any number of Themes could be used in additional versions of the FourBid™ card game, such as transportation, science, sports, etc.

As used herein an "Official Rules Sheet" of the FourBid™ card game is defined as the setup instructions, and rules that govern the play.

As used herein an "Tactics & Examples Booklet" of the FourBid™ card game is defined as basic tips and considerations for playing the FourBid™ card game, as well as illustrated examples of Game situations.

As used herein the terms "Go Out", "Going Out", "Goes Out" and "Went Out" in the FourBid™ card game are defined as the point in a Round of Play where a player ends the Round of Play by being the first player to place their "FourBid™" Indicator Card Face Up in the Indicator Card Tray of their Game Board.

As used herein a "Cycle of Bidding" is defined as the verbal process of players executing a Turn in which a Cycle of Bidding is required by rule. This consists of players bidding against one another in hopes of winning the right to complete that Turn. A player must raise a bid by one (1) up to the highest bid of four (4), or pass. Bidding is explained further in the Playing the FourBid™ card game section of this detailed description.

BRIEF DESCRIPTION OF FIGURES

FIG. 6 provides the Player Position Chart, which represents the location of player seating at the Game Hub for each new Game played in a Tournament of the FourBid™ card game.

Figure 1A:
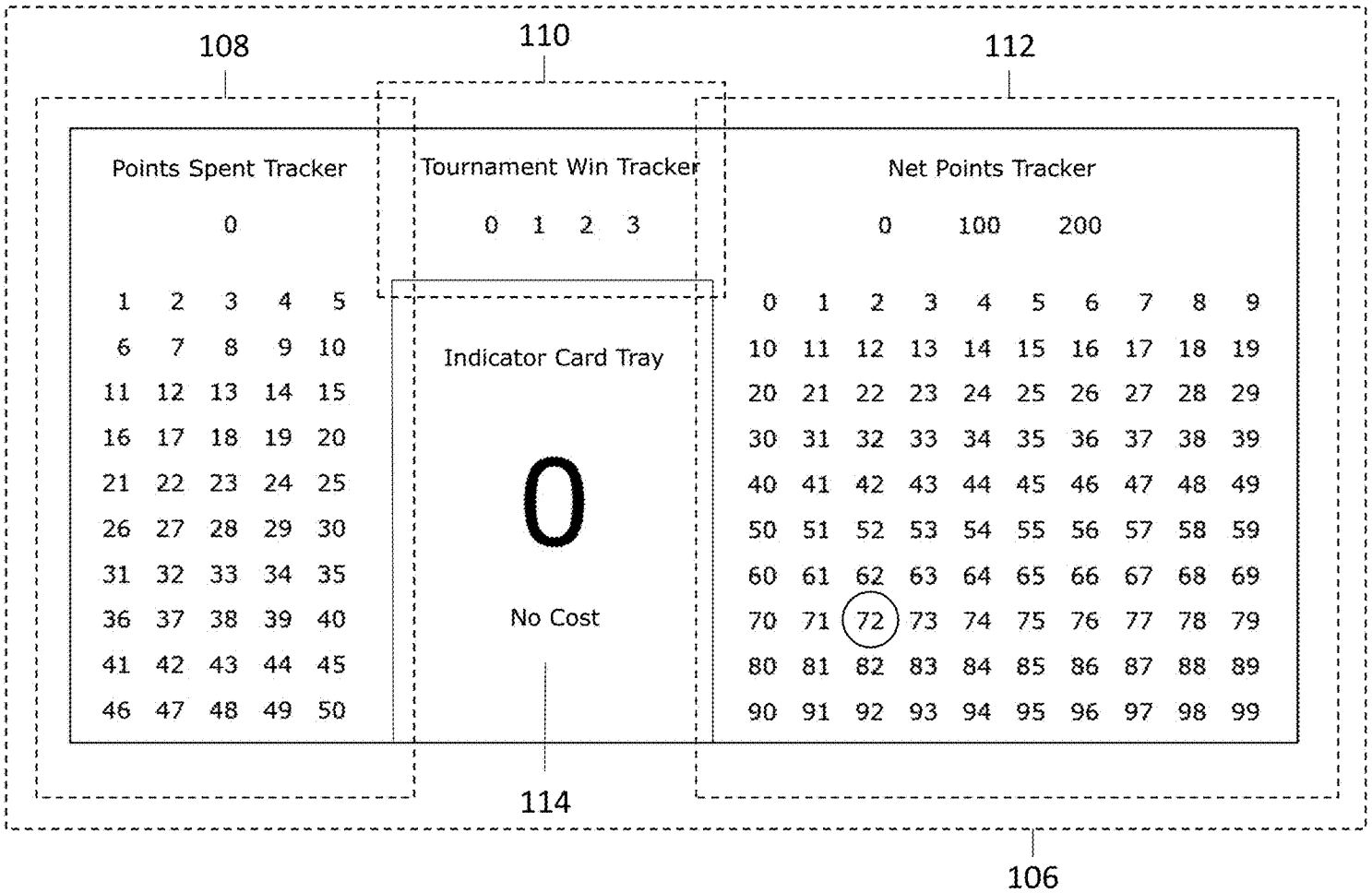
FIG. 1A is an illustration of an embodiment of a Game Board according to one embodiment of the FourBid™ card game.

The figures herein follow a numbering convention in which the first digit or digits correspond to the drawing figure number and the remaining digits identify an element in the drawing. Similar elements between different figures may be identified by the use of similar digits. For example, 102 may reference element "02" in FIG. 1, and a similar element may be referenced as 202 in FIG. 2. It is emphasized that the purpose of the figures is to illustrate and the figures are not intended to be limiting in any way. The figures herein may not be to scale and relationships of elements in the figures may be exaggerated. The figures are employed to illustrate conceptual structures and methods herein described.

In addition, multiple analogous elements within one figure may be referenced with a reference numeral followed by a hyphen and another numeral or a letter. For example, 110-1 may reference element 10-1 in FIGS. 1 and 110-2 may reference element 10-2, which can be analogous to element 10-1. Such analogous elements may be generally referenced without the hyphen and extra numeral or letter. For example, elements 110-1 and 110-2 may be generally referenced as 110.

The Parts of the FourBid™ Card Game

The following discussion refers to FIGS. 1A through 6. The FourBid™ card game uses one Game Hub. FIGS. 1A and 1B provide illustrations of the Game Hub 100 for the FourBid™ card game. As seen the Game Hub 100 (FIG. 1B) includes a Rotating Double Card Tray 101 consisting of a Draw Tray 102 and a Discard Tray 104. Four Game Boards 106 surround the Game Hub 100 (106-1, 106-2, 106-3, 106-4). Each Game Board 106 (FIG. 1A) has three score tracking areas, including a Points Spent Tracker 108, a Tournament Wins Tracker 110, and a Net Points Tracker 112. As seen in FIG. 1A, the Net Points Tracker 112 includes a first zone having non-negative integers of 0 to 99 and a second zone having 0, 100 and 200. Each Game Board 106 (FIG. 1A) also include an Indicator Card Tray 114.

Figure 1B:
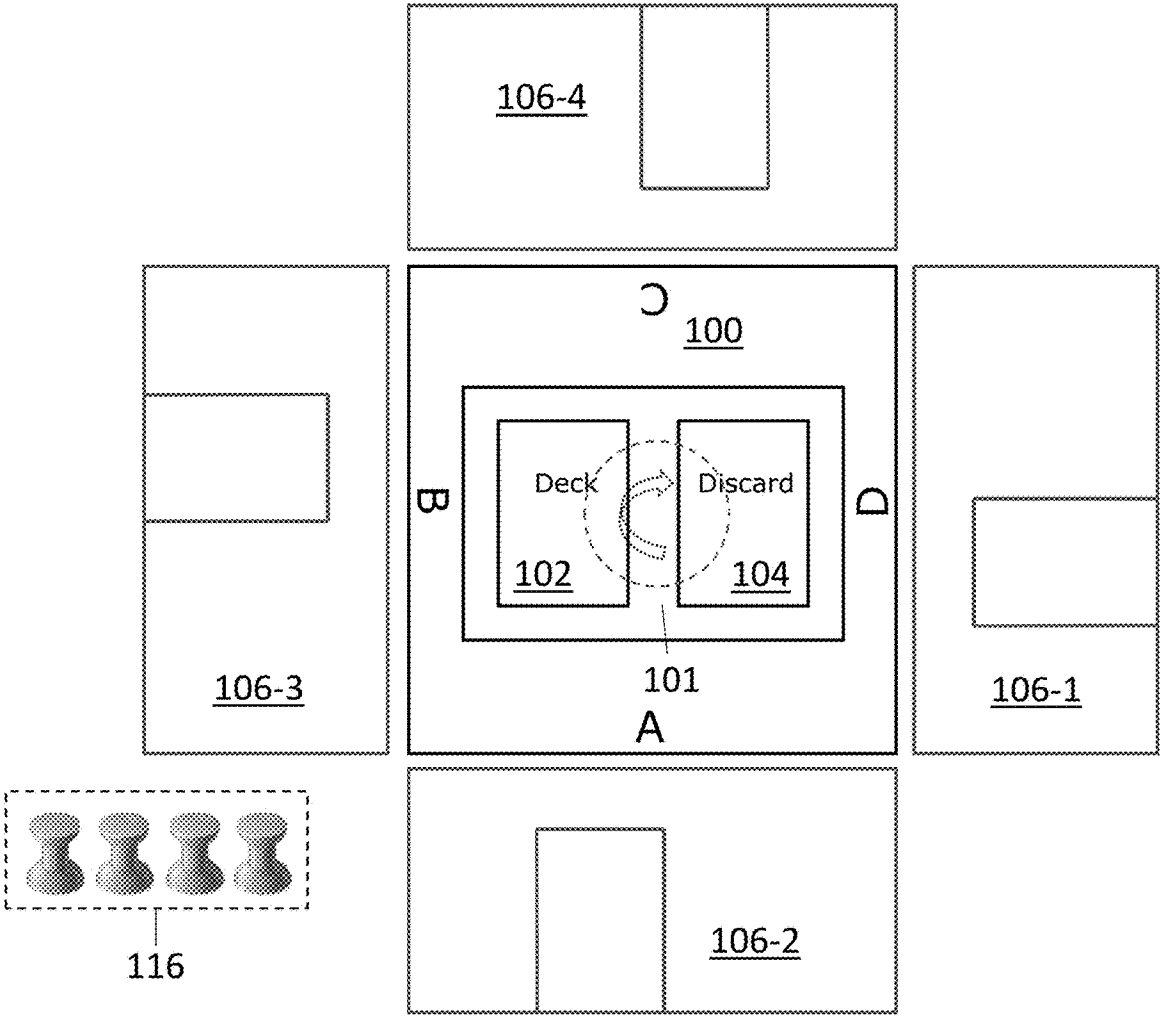
FIG. 1B is an illustration of an embodiment of a Game Hub, surrounded by four (4) Game Boards according to one embodiment of the FourBid™ card game.

In addition, the FourBid™ card game further includes four sets of Score Markers 116. FIG. 1B provides an illustration of one set of four individual Score Markers 116. Each set of Score Markers 116 has a predetermined color that is different than the other sets of Score Markers 116. For example, a first set of Score Markers 116 is yellow, a second set of Score Markers 116 is blue, a third set of Score Markers 116 is red and a fourth set of Score Markers 116 is green.

Other color and/or patterns of colors and/or shapes can be used for each set of the Score Markers 116.

Figure 2:
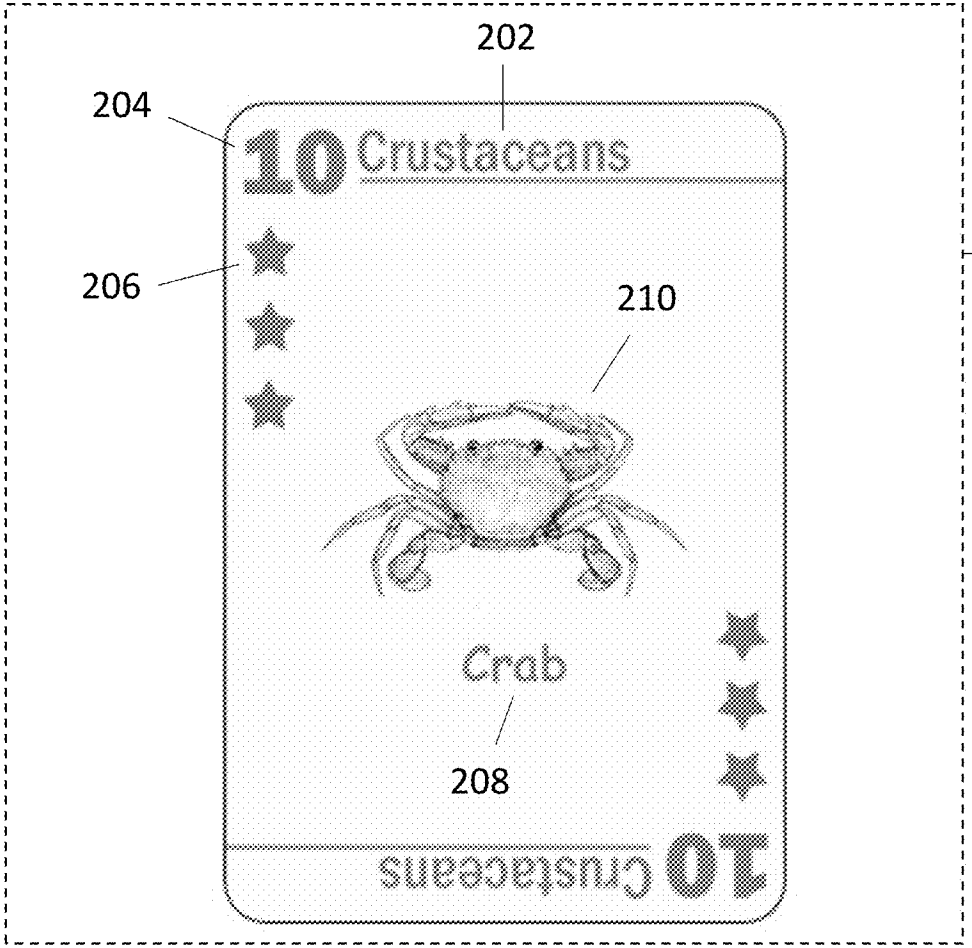
FIG. 2 provides an illustration of an "Ocean Life" themed Point Card for the FourBid™ card game.

Referring now to FIG. 2, there is shown an example of a Point Card 200. As illustrated, each Point Card 200 includes a first major surface on which is a combination of a Classification Set Name 202, a Point Value Indicator 204, a Symbol 206 representing the Classification Set, a Common Name 208 representing the individual Point Card, and an Image 210 representing the individual Point Card. The Point Card 200 also has a predetermined color that is used for the Classification Set Name 202, the Point Value Indicator 204, and the Symbol 206. For example, the color orange can be used for the "Crustaceans" Classification Set of the Point Cards, where the "Crab" is seen as an example in FIG. 2, whereas other colors are used to represent the other seven (7) Classification Sets.

The use of the Symbol 206, such as a star, circle or other geometric shape (filled, patterned or unfilled) that extend down an area that is adjacent to a top portion of the left lateral edge of the Point Card 200 helps provide easy identification of the Classification Set 202 to the player when the Point Cards 200 of their Hand are held in a "fan" pattern. The Symbol 206 also acts as the easiest way to quickly recognize matching sets, and acts as a big help for people that are color blind.

Figure 3:
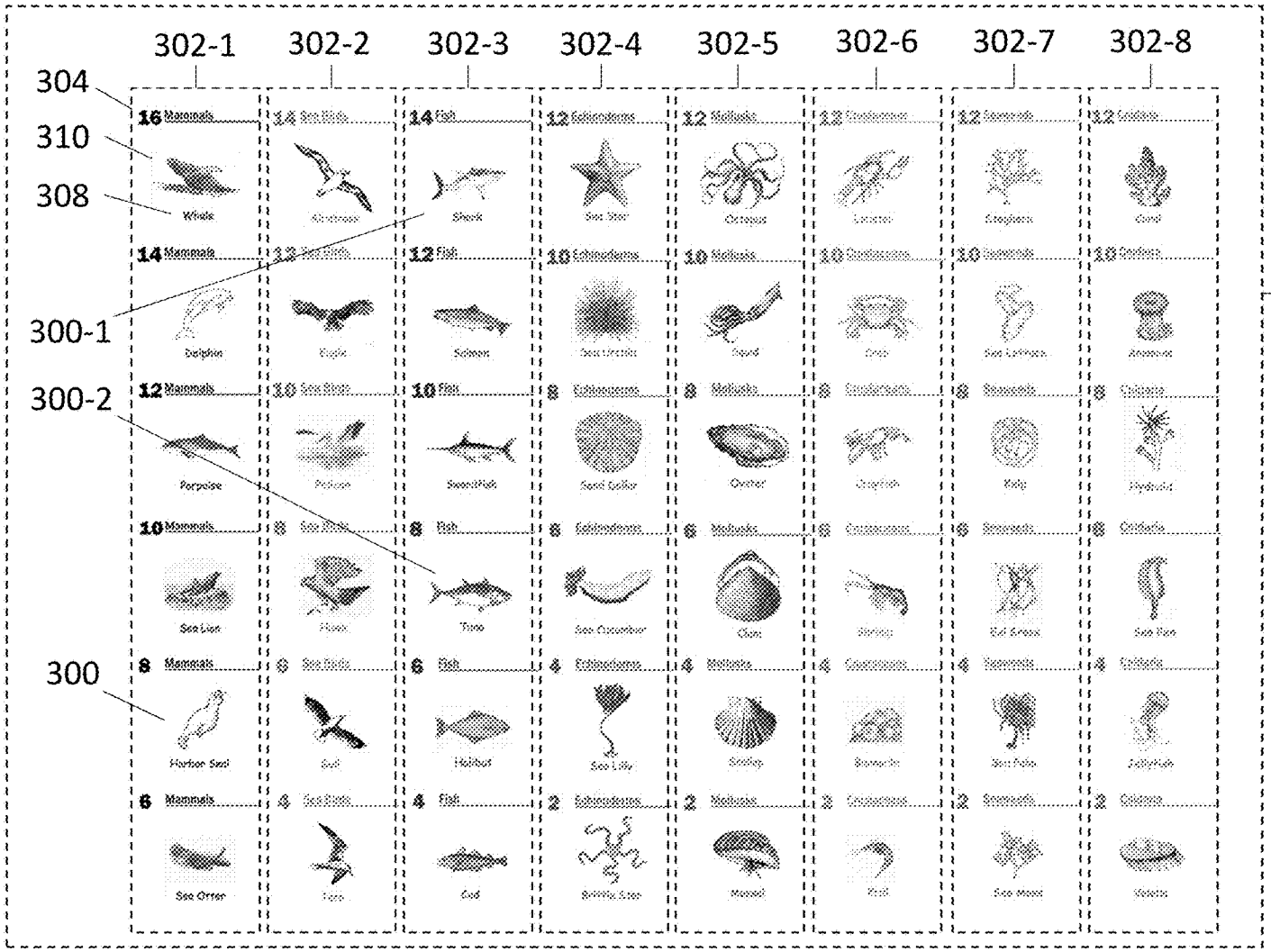
FIG. 3 provides an illustrated grid representing of all eight Classification Sets of "Ocean Life" Themed Point Cards for the FourBid™ card game. This grid includes 48 of the 51 Point Cards used for the FourBid™ card game FIG. 4 provides an illustration of a set of four Indicator Cards for the FourBid™ card game.

The FourBid™ card game includes fifty-one (51) Point Cards. Making up the fifty-one (51) Point Cards are the forty-eight (48) Point Cards seen in FIG. 3 and the three "Wild Cards" seen in FIG. 5, both of which are more fully discussed herein. As seen in FIG. 3, the forty-eight Point Cards 300 are divided into eight Classification Sets 302, which the Wild Card Set 500 has no classification set as each can belong to any of the eight Classification Sets 302. Each of the eight Classification Sets 302 of Point Cards 300 includes six Point Cards, and the Wild Card Set 500 includes three Point Cards, which by definition can belong to any of the eight Classification Sets 302.

FIG. 3 provides an illustrated grid of forty-eight (48) Point Cards 300 as divided into eight (8) Classification Sets 302. Point Value Indicators 304 for each Point Card 300, the Common Name 308 for the image on each Point Card 300 and the Image 310 on each Point Card 300 is also represented. The grid is a representation of one embodiment of the FourBid™ card game. Moving from left to right, there is a "Mammal" Classification Set 302-1; a "Sea Bird" Classification Set 302-2; a "Fish" Classification Set 302-3; a "Echinoderms" Classification Set 302-4; a "Mollusks" Classification Set 302-5; a "Crustaceans" Classification Set 302-6; a "Seaweeds" Classification Set 302-7; and a "Cnidaria" Classification Set 302-8. As discussed herein, each Classification Set 302 has a predetermined color that is used. For example, the predetermined color for the "Mammal" Classification Set 302-1 can be black; the predetermined color for the "Sea Bird" Classification Set 302-2 can be blue; the predetermined color for the "Fish" Classification Set 302-3 can be green; the predetermined color for the "Echinoderms" Classification Set 302-4 can be red; the predetermined color for the "Mollusks" Classification Set 302-5 can be purple; the predetermined color for the "Crustaceans" Classification Set 302-6 can be orange; the predetermined color for the "Seaweeds" Classification Set 302-7 can be green; and the predetermined color for the "Cnidaria" Classification Set 302-8 can be yellow.

As seen in FIG. 3, each representation of a Point Card 300 has a Point Value Indicator 304. It is also noted, however, that a Point Value Range for a given Classification Set 302 can be the same or different. For example, the Point Value Range for the "Mammal" Classification Set 302-1 is 6 to 16. For the present example, the other Classification Sets 302 have the following Point Value Range: "Sea Bird" Classification Set 302-2 has a range of 4 to 14; "Fish" Classification Set 302-3 has a Point Value range of 4 to 14; "Echinoderms" Classification Set 302-4 has a Point Value Range of 2 to 12; "Mollusks" Classification Set 302-5 has a Point Value Range of 2 to 12; "Crustaceans" Classification Set 302-6 has a Point Value Range 2 to 12; "Seaweeds" Classification Set 302-7 has a Point Value Range of 2 to 12; and "Cnidaria" Classification Set 302-8 has a Point Value Range of 2 to 12.

So, as illustrated, the Mammal Classification Set 302-1 has the highest Point Value Range of all Classification Sets 302 of Point Cards. The "Sea Bird" Classification Set 302-2 and the "Fish" Classification Set 302-3 shard the same Point Value Range. Finally, the "Echinoderms" Classification Set 302-4, the "Mollusks" Classification Set 302-5; the "Crustaceans" Classification Set 302-6; the "Seaweeds" Classification Set 302-7; and the "Cnidaria" Classification Set 302-8 each have the same Point Value Range. FIG. 3 also illustrates that each Point Card 300 has its own Point Value Indicator 304 and the point values are different within each Classification Set 302. So, for example, the "Fish" Classification Set 302-3 has a Point Value range of 4 to 14, where the "Shark" Point Card 300-1 has a point value of 14 while the "Tuna" Point Card 300-2 has a point value of 8.

As illustrated in FIG. 3, there are a total of forty-eight Point Cards 300, where there are six Point Cards 300 for each of the eight Classification Sets 302. It is appreciated that a different number of Classification Sets, Point Cards per Classification Set and/or the total number of Point Cards could be used in the FourBid™ card game. If additional Point Cards are used to provide more than eight Classification Sets, each additional Classification Set will have its own predetermined color. It is appreciated that less than eight Classification Sets and/or less than six Point Cards can be used in the FourBid™ card game. This latter case may be used for a "junior" version of the FourBid™ card game, which would be directed to players under the age, for example, of ten (10) years old.

As seen and discussed herein, the Point Cards for the FourBid™ card game are associated with a "theme." In the example illustrated in FIG. 3, the "theme" is Ocean Life, which forms the basis for the Classification Sets. For this example the Point Cards could be referred to as "Ocean Life Point Cards", or simply "Ocean Life Cards". This theme is only one example of many possible themes that could be used. The theme and information provided on each of the Point Cards can be used, in addition to playing the FourBid™ card game, to educate the players on the item seen in the image on the Point Card. So, for the various embodiments, the theme for the Point Cards can be derived from any number of classification systems for living and/or non-living items. For example, the theme for the Point Cards could be derived from the living organisms in the kingdom classification (e.g., Animal, Plant, Fungi, Bacteria and Protists). By way of example, if the animal kingdom were selected the phylum of that kingdom could then be used to help further classify the Point Cards, where examples of the phylum include Cnidaria (invertebrates), Chordata (vertebrates), Arthropods, Mollusks and Echinoderms. Examples of these are seen in the embodiment of the Point Cards represented on the grid in FIG. 3 (e.g., mollusks and echinoderms among others). The class can also be used in classifying the Point Cards, where for example Chordata (vertebrates) phylum splits up into Mammalia (Mammals), Actinopterygii (Bony Fish), Chondrichthyes (Cartilaginous Fish), Ayes (Birds), Amphibia (Amphibians) and Reptilia (Reptiles). Order, family, genus and/or species can be used to further provide the class for a set of the Point Cards.

It is also possible to use other themes with their own classification systems to develop sets of Point Cards for use in the FourBid™ card game. Examples of such themes include, but are not limited to, those associated with rocks (e.g., igneous, sedimentary, metamorphic), the universe (e.g., classifications for and examples of planets, asteroids, stars and/or galaxies), plants, fungi, Bacteria and/or protists. Sports could also as a theme with their own classification systems to develop sets of Point Cards for use in the FourBid™ card game.

Figure 4:
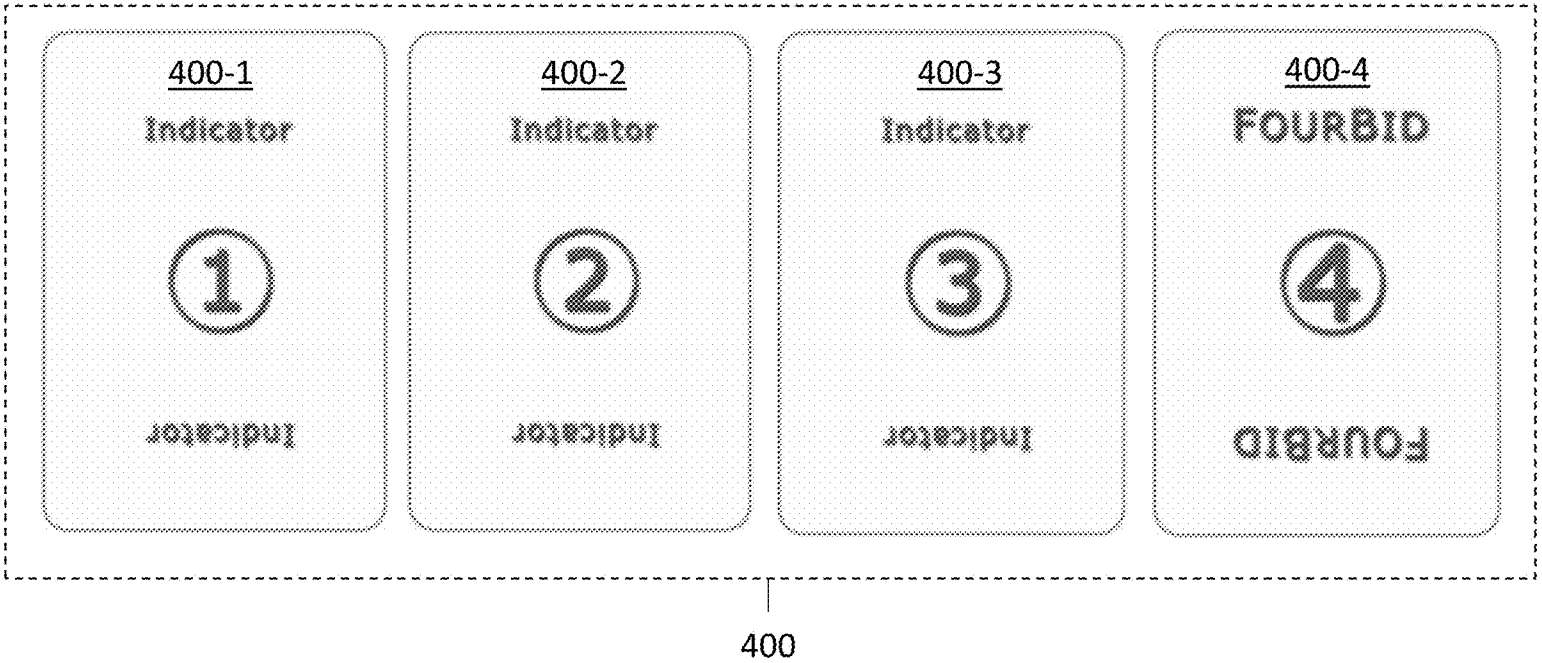

Referring now to FIG. 4, there is shown an example of a set of Indicator Cards 400 of the four sets of Indicator Cards. The set of Indicator Cards 400 seen in FIG. 4 include four Indicator Cards 400-1, 400-2, 400-3 and 400-4 each having a first major surface with an identifying value 402 that is different than the identifying value 402 on the other Indicator Cards 400. As illustrated, Indicator Card 400-1 has the identifying value "1"; Indicator Card 400-2 has the identifying value "2"; Indicator Card 400-3 has the identifying value "3" and Indicator Card 400-4 has the identifying value "4". In addition, Indicator Card 400-4 not only has the identifying value "4" it is the only card that also includes the term "FourBid™". The significance of Indicator Card 400-4 with the term "FourBid™" will be discussed more fully herein.

In the present embodiment, there are four sets of four Indicator Cards 400 to provide a total of sixteen Indicator Cards 400. Each set of four Indicator Cards 400 has a determined color that is different than the other sets of four Indicator Cards 400. For example, a first set of four Indicator Cards 400 can be yellow, a second set of four Indicator Cards 400 can be blue, a third set of four Indicator Cards 400 can be red and the fourth set of four Indicator Cards 400 can be green. The colors of each set of four Indicator Cards 400 are the same as the four colors used for the Score Markers and Game Boards discussed above. As such, each of the four players of the FourBid™ card game select one of the four predetermined colors to represent them during the Game, where the player will collect and use the set of Indicator Cards, Score Markers, and Game Board having the same color (e.g., red).

Figure 5:
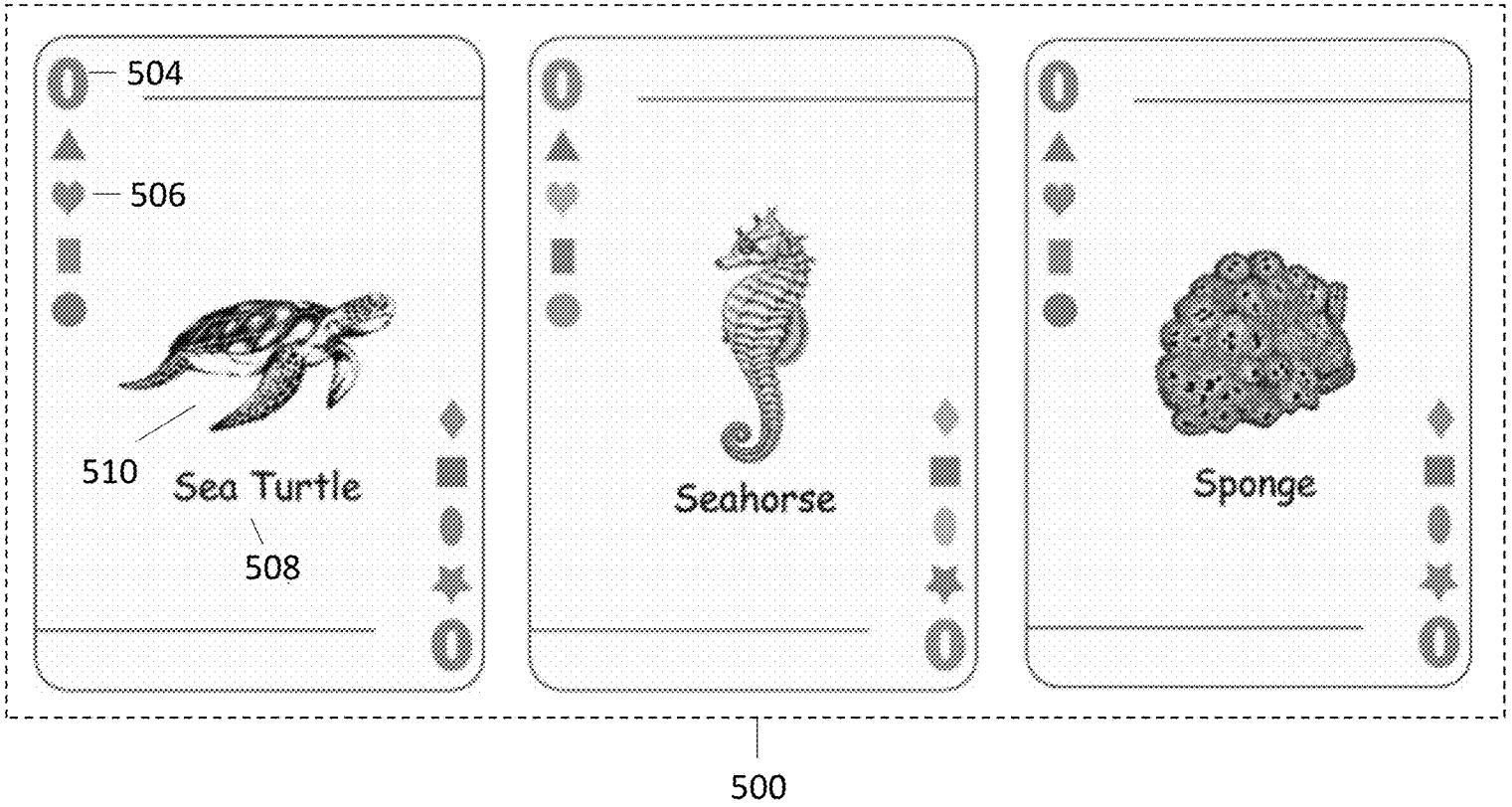
FIG. 5 provides an illustration of all three "Ocean Life" Themed Wild Cards for the FourBid™ card game.

Referring now to FIG. 5, there is shown an example of the Wild Card Set 500 of the Point Cards. Each of the Point Cards of the Wild Card Set 500 has a value of zero (0) points. The first major surface of each of the three Point Cards 500 (the "Wild Cards") includes an Image 510, a Common Name for the Image 508 and a Point Value Indicator 504 of zero (0). Wild cards are bordered with one of each shape and color Symbols 506 found in each of the eight Classification Sets.

As noted, these three Point Cards can be referred to as "wild", meaning they can be chosen by a player to become part of any of the eight Classification Sets so as to complete a set of Point Cards that makes them Eligible to "Go-Out", as will be discussed more fully herein.

So, the deck of Point Cards at the beginning of a Game of the FourBid™ card game will have fifty-one cards (eight (8) Classification Sets of six (6) Point Cards having a point value greater than zero (0) plus the three (3) Point Cards having a value of zero (0) (e.g., the "wild cards").

Referring now to FIG. 6, there is shown a chart consisting of numbers and letters for players to reference when moving positions between games of the FourBid™ card game. This is known as the Player Position Chart 600, and its use will be described more fully herein.

Playing the FourBid™ Card Game

The FourBid™ card game is played with four players. It would be possible to configure the cards, the Game Hub, the Game Boards and the score tracking areas to play the FourBid™ card game with more than or less than four players. The following discussion of how to play the FourBid™ card game, however, will use four players.

Based on the discussion above, each of the four players choose a color to represent themselves and receive the corresponding set of four colored Indicator Cards (400), and matching Game Boards (106), and Score Markers (116).

Each player places their Score Markers (116) on the "zeros" of each of the Score Trackers (108, 110 and 112 seen in FIG. 1A and discussed herein) of their Game Board (106).

The Game Hub (100) is placed in the center of a playing area (ideally a card table) where it's easy to identify each player sitting across from one of the four marked positions (A, B, C, D).

Each player draws from any one player's set of Indicator Cards (400). Based on the number they draw, players then position themselves at the Game Hub (100) according to the Player Position Chart (600) seen in FIG. 6. The Indicator Cards (400) are then returned to the player that allowed them to be used for the draw.

All fifty-one Point Cards are shuffled before the start of a "Game" of FourBid™, between each Hand of FourBid™, and between each Round of Play of FourBid™.

The player sitting at position "A" deals the first Hand. The order of play moves in a clockwise direction. Each new Hand in each new Round of Play will be dealt by the player to the left of the person who dealt last.

With each subsequent new Game (of Tournament play), players will reposition themselves and their Game Boards (106) at the Game Hub (100), according to the Player Position Chart (600). The person sitting at position A always deals the first Hand of every new Game.

At the start of each Round of Play, four Point Cards (200) are dealt Face Down to each player. These in addition to the four Indicator Cards (400) that were distributed earlier, means each player starts with a Hand consisting of eight cards.

Undealt Point Cards (200) are placed Face Down in the side of the Rotating Tray (101) marked "Deck" (102). During the course of play, discards will be placed Face Up in the side marked "Discards" (104).

There are two options for playing the FourBid™ card game. It's recommended to be played as a Tournament, with the championship awarded to the first player to win 3 games (each game up to 72 points). The pace of play, and the mixing of player positions during a Tournament maximizes the fun, and often keeps all players alive and involved to the very end. A single game is another option. Players can declare any point total as the amount needed to win the game. Games to either 100 or 200 are the most common choices.

Typically, it takes 3 Rounds of Play of a Game of the FourBid™ card game before any one player surpasses the threshold of 72 Net Points to win the game. During the Round of Play, a player's goal is to acquire 4 or more Point Cards (200) of any of the 8 Classification Sets (302). When this is achieved, a player is eligible to "Go Out". Point Cards (200) and Indicator Cards (400) are strategically discarded in the quest to earn the most points possible, and to be the player to "Go Out."

The initial Turn begins with the player sitting to the left of the dealer. Subsequent Turns always begin with the player to the left of the player that completed the last Turn by discarding. A player that begins a Turn is not always the same player that completes it.

Point Cards (200) are acquired by drawing from either the top of the Draw Deck, or the top of the Discard Pile. All Turns include the actions of one player acquiring a card, followed by discarding a card of their choice. Therefore, players always begin and end a turn with 8 cards in their Hand.

Discarding is defined as a player either placing a Point Card (200) of their choice Face Up in the Discard Pile, or by placing an Indicator Card (400) in the Indicator Card Tray (114) of their Game Board (106). Indicator Cards (400) must be discarded in order (from 1 to 4) and are placed Face Up on top of one another.

As Turns are taken, each player's intent is to strengthening their Hand by gathering cards of similar Classified Sets (303) and high point values (304). By rule, at the first point in the Round of Play where a player discards an Indicator Card (400) instead of a Point Card (200), a Cycle of Bidding becomes part of each turn. As always, the player to the left of the player that completed the previous Turn by discarding, starts the next Turn. Rather than drawing, that person must start a Cycle of Bidding by bidding "1." They have no other choice. The player who completed the previously turn is NOT eligible to bid, only the other 3 players will participate. Each bidder (next player to the left) must either raise the bid by one, or "Pass." As soon as a player passes, the previous bid becomes the "winning" bid, and that player gets to complete the Turn. Bids cannot go higher than 4, meaning that if every eligible player raised the bid, the first bidder gets the final decision to either raise the bid to the maximum "4", or "Pass."

Players winning bids during the course of a Round of Play in the FourBid™ card game are tracked as Points Spent. The cost of any player's winning bid is defined as the number that they bid (1, 2, 3, or 4) multiplied by the number of the Indicator Card (400) that is currently showing in the Indicator Card Tray (114) of their Game Board (106).

Players will be considering the potential cost of bidding and weighing the advantage of being able to complete the Turn against other factors. Players without an Indicator Card (400) showing in their Indicator Card Tray (114) are in a "No Cost" situation, since any number multiplied by zero is always zero.

As a Round of Play progresses, the cost of winning a bid increases. For example, if a player's bid is "4" and the Indicator Card (400) in front of them is "2" (400-2), then they will have to "spend" 8 points (4×2=8).

When a Cycle of Bidding is complete, the player that wins the right to complete the turn must track any points they have just spent by moving their Score Marker (116) ahead on the Points Spent Tracker (108) of their Game Board (106) by the amount they spent to win the bid.

All players earn points based on the makeup of their individual Hand at the end of the Round of Play. Earned Points are defined as the highest point total from any one Classification Set (302) of Point Cards (300) in their Hand.

Players also earn Bonus Points by Going Out and in other ways explained more fully herein. The first player to discard their "4" (marked FourBid™) Indicator Card (400-4) immediately ends the Round of Play and earns that player 24 Bonus Points. As stated already, in order to do this, that player must be eligible to "Go Out," meaning their Hand must contain four or more Point Cards (300) of the same Classification Set (302), and that player must have already discarded their previous 3 Indicator Cards (400-1, 400-2, 400-3) in order.

The other three players can earn Bonus Points at the end of the Round of Play too, by winning or tying a "Bid-Four Challenge" which is explained more fully herein. A player that wins a Bid-Four Challenge gets 12 Bonus Points, and if they tie their Bid-Four Challenge, they get 8 Bonus Points.

The Bid-Four Challenge works as follows: When a Round of Play has ended, and before any Hands are shown, the player that Went Out asks if any other players (starting with the player to their left) would like to spend 4 points in order to challenge the Earned Point total of their Hand. Each player either challenges (moves their Score Marker (116) on their Points Spent Tracker (108) ahead by 4 points), or declines. Hands are then shown and Earned Point totals are compared. If any of the challengers have more Earned Points than the player that Went Out, they win the challenge (worth 12 Bonus Points). If the point totals are the same, they tie the challenge (worth 8 Bonus Points). It should be noted that the Bid-Four challengers are only comparing their Hand against the player that Went Out, not any other player.

At the end of each Round of Play, Net Points are calculated. Net Points=Earned Points+Bonus Points−Points Spent. After a player Goes Out, the following steps take place:

1) Bid Four Challenges are declared or declined.
2) Earned Points are totaled (and compared).
3) Net Points are calculated.
4) Players move their Score Marker (116) on the Net Points Tracker (112) ahead to their accumulated score of the game.
5) Players reset their Points Spent Tracker (108) by moving their Score Marker (116) back to zero.

There are three "special rules" that players need to abide by during a Round of Play in the FourBid™ card game. The first of these three special rules was mentioned earlier. It requires a Cycle of Bidding to begin once the first Indicator Card (400-1) has been discarded by any player, and that the Cycle of Bidding then becomes part of every Turn through the Rest of the Round of Play.

The second special rule states that the player that discards the first Indicator Card (400-1) of any Round of Play, does so at a cost of 4 points (defined as moving their Score Marker (116) on their Points Spent Tracker (108) ahead by 4 points). This rule is in place to add some cost to the player that takes the early lead in the race to Go Out. This rule also often delays the point in the Round of Play when the first special Rule (Cycle of Bidding required) kicks in.

The third special rule states that the first time any player discards the Indicator Card numbered "2" (400-2), means that any players that have not yet played an Indicator Card (400), must do so the next time they complete a turn. This rule is in place to make sure players don't have the option of bidding in a No Cost situation lasting the entire Round of Play.

There are three more rules that govern certain circumstance that may come up during a Round of Play. The first of these circumstantial rules regards instances when the Draw Deck runs out before the Round of Play is concluded. If this occurs, all the cards in the Discard Pile except the top card shall be removed, shuffled and placed Face Down in the Draw Tray (102) and the Round of Play proceeds.

The second circumstantial rule regards the rare occasion when a player may have a particularly bad Hand that earned less points than they spent. In that circumstance, the player will not have to subtract anything after the Round of Play is complete. The Score Maker (116) on their Net Points Tracker (112) will simply remain in place.

The third circumstantial rule is in place for an occasion when two or more players end up with a tied highest score above the winning threshold. In that circumstance, another Round of Play must be played, with all players remaining in the game.

By way of strategy, it's always desirable for a player to win a bid in order to complete a Turn, as it's the only way to improve their Hand, but in the FourBid™ card game, players must consider what it is worth to them based on the cost to themselves (e.g., spending points), the potential cost to their opponents (if they choose to pass rather than bid), their evaluation of the state of the Round of Play, and the overall score of the Game. Often the main tactic of a bidding decision may be less about a player's own desire to complete a Turn, and more about the desire to prevent another player from completing the Turn. In this respect, the bidding decision can often be a method to manipulate the order of play and thus a defensive strategy, or an advantageous way to setup the start of the next Turn.

Risk evaluation, the ability to pay attention to all cards, and reading what other players might be up to are all important elements of the FourBid™ card game. As already mentioned, tactics mostly lie within a player's decision to bid or pass. A player that is too aggressive will spend too many points and up with a low Net Points total. A player that is too conservative will get very few new cards, and therefore not many Earned Points and not much potential for Bonus Points.

When playing the FourBid™ card game, players will have insight into how close other players are to Going Out because of the Indicator Cards (400). A player with no Indicator Cards (400) Face Up in the Indicator Card Tray (114) of their Game Board (106) is not close to Going Out. A player showing an Indicator Card 3 (400-3), or even 2 (400-2), often possesses a Hand that is eligible to Go Out either immediately, or within one good draw.

Another thing players will need to pay close attention to when playing the FourBid™ card game is which Point Cards (200) their opponents are discarding. Since there are only six cards in each Classification Set (302), players must take note of which Classification Sets (302) might be getting buried in the discard tray.

As stated already, there is a cost of 4 points to the first player that discards an Indicator Card (400-1) during the Round of Play of the FourBid™ card game. That's because there is an advantage to taking the lead in the race to Go Out. There is also an advantage in that discarding an Indicator Card (400) allows more room in a player's Hand for Point Cards (200). In contrast to the benefits of discarding Indicator Cards (400) faster than your opponents, is the potential to incur more cost in order to win a Cycle of Bidding.

Players might consider a strategy to spend as few points as possible during a Round of Play in the FourBid™ card game if they have great cards early, with a high total of Earned Points. The hope in that case is that they would easily win a Bid-Four Challenge and end up with a relatively large amount of Net Points.

Another thing to be aware of is that Wild Cards (500) have no point value. They are beneficial in the race to Go Out, but if a player does not think they are going to be the first to Go Out, they offer no benefit to that player's Hand.

Often the top card in the Discard Pile is of no value to a player, but that doesn't mean they shouldn't bid. The next card off the top of the Draw Deck is an unknown, and may not help their Hand, but winning the bid still does two things: 1) It keeps an opponent from completing the Turn, and 2) It enables a player to discard an Indicator Card (400) which will get them closer to Going Out.

In most cases it's wise for a player to make the effort to Go Out as soon as they can during a Round of Play in the FourBid™ card game, but occasionally a player will benefit by holding off and trying to obtain an extra Point Card (200) or a higher Value (204) Point Card (200) in the Classification Sets (302) they are accumulating. This can especially be true when the player is utilizing one or more Wild Cards (500).

What is claimed is:

1. A game, comprising:

a game hub having:

a draw tray and a discard tray for point cards; and four game boards surrounding the game hub, wherein each of the four game boards includes a points spent tracker comprising a grid of a plurality of numbers representing points spent, a tournament win tracker comprising a plurality of numbers representing a number of tournament wins, a net points tracker comprising a grid of a plurality of numbers representing accumulated net points and an indicator card tray for indicator cards;

four sets of score markers for placing on the game board, wherein each set of score markers includes a first score marker placed and moved on the points spent tracker, a second score marker placed and moved on the tournament wins tracker and a third score marker placed and moved on the net points tracker, wherein each of the four sets of score markers has a predetermined color that is different than the other sets of score markers;

sixteen indicator cards for placing in the indicator card tray, the sixteen indicator cards divided into four sets of four indicator cards, wherein each of the four sets of the four indicator cards has a determined color that is different than the other sets of four indicator cards and wherein each indicator card includes a first major surface and wherein each of the four sets of four indicator cards includes a first indicator card with an identifying value one (1) on the first major surface, a second indicator card with the identifying value two (2) on the first major surface, a third indicator card with the identifying value three (3) on the first major surface and a fourth indicator card with the identifying value four (4) and the term "FourBid™" on the first major surface; and fifty-one point cards for placing in the draw tray and the discard tray of the game hub, the fifty-one points cards divided into eight classification sets and a wild card set, wherein each point card includes a first major surface and each set of the eight classification sets of point cards includes six point cards and wherein each of the point cards in the eight classification sets has on its first major surface comprising a combination of:

a classification set name;

a point value indicator;

a symbol having a shape and color representing the classification set;

an image representing the classification set name; and a common name for the image;

where the combination on the first major surface is different for each of the point cards in the eight classification sets, and wherein the wild card set includes three point cards each having a number zero on the first major surface, where the wild cards are bordered with one of each shape and color symbols found in each of the eight classification sets.

2. The game of claim 1, wherein the draw tray holds point cards.

3. The game of claim 1, wherein the discard tray holds point cards.

4. The game of claim 1, wherein the draw tray and the discard tray of the game hub are mounted on a rotating platform to allow for both the draw tray and the discard tray of game hub to turn or swivel 360 degrees in either direction.

5. The game of claim 1, wherein the indicator card tray holds indicator cards.

6. The game of claim 1, wherein the grid of the plurality of numbers for the net points tracker includes a first zone having non-negative integers of 0 to 99 and a second zone having 0, 100 and 200.

7. The game of claim 6, wherein each set of score markers includes a fourth score marker used with the game board, wherein the third score marker is used in the first zone and the fourth score marker is used in the second zone.

8. The game of claim 1, wherein each classification set name of the eight classification sets has a different classification set name.

9. The game of claim 1, wherein the classification set name, the point value indicator, the image representing the classification set name and the common name for the image for each of the six point cards of a classification set has a predetermined color.

10. The game of claim 9, wherein the predetermined color is different for each classification set of the eight classification sets.

11. The game of claim 1, wherein each of the sixteen indicator cards and the fifty-one point cards includes a second major surface opposite the first major surface, the second major surface having a singularly themed design.

* * * * *